United States Patent [19]

Chihara et al.

[11] 4,338,510

[45] Jul. 6, 1982

[54] ELECTRODE TYPE STEAM VAPORIZER HAVING CORROSION RESISTANT NICKEL FERRITE ELECTRODES AND A PROTECTIVE COVER

[75] Inventors: Masao Chihara; Shigeo Araki; Kazuhiko Asakawa, all of Tokyo, Japan

[73] Assignee: TDK Electronics Co., Ltd., Tokyo, Japan

[21] Appl. No.: 878,787

[22] Filed: Feb. 17, 1978

[30] Foreign Application Priority Data

May 11, 1977 [JP] Japan ..... 52-58841[U]

[51] Int. Cl.[3] ..... H05B 3/60; F22B 1/30

[52] U.S. Cl. ..... 219/288; 128/203.17; 128/203.27; 128/367; 204/292; 219/275; 219/295; 261/141; 338/80

[58] Field of Search ..... 219/284–295, 219/271–276; 338/80–86; 204/290 R, 291–293; 261/141; 128/203.17, 203.27, 367

[56] References Cited

U.S. PATENT DOCUMENTS

| | | | |
|---|---|---|---|
| 931,513 | 8/1909 | Specketer | 204/291 |
| 1,079,269 | 11/1913 | Seeger | 204/291 |
| 1,166,950 | 1/1916 | Von Hentzel | 219/291 |
| 1,782,069 | 11/1930 | Hemmings | 219/295 X |
| 1,806,729 | 5/1931 | Aitken | 219/275 X |
| 2,076,709 | 4/1937 | Deutsch | 219/275 |
| 3,659,078 | 4/1972 | Rudstrom | 219/284 |
| 4,039,417 | 8/1977 | Sasaki et al. | 204/291 |
| 4,132,883 | 1/1979 | Grime | 219/284 |
| 4,169,028 | 9/1979 | Yokoyama et al. | 204/291 |

FOREIGN PATENT DOCUMENTS

| | | | |
|---|---|---|---|
| 49-123481 | 11/1974 | Japan | 204/291 |
| 51-43378 | 4/1976 | Japan | 204/291 |
| 51-43379 | 4/1976 | Japan | 204/291 |
| 51-47552 | 4/1976 | Japan | 204/291 |
| 452151 | 5/1968 | Switzerland | 219/285 |
| 1520926 | 8/1978 | United Kingdom | 204/291 |

*Primary Examiner*—A. Bartis

*Attorney, Agent, or Firm*—Oblon, Fisher, Spivak, McClelland & Maier

[57] ABSTRACT

An electrode type steam vaporizer device is disclosed which includes a plurality of ferrite electrodes positioned in a water receptacle wherein AC voltage is applied to the electrodes thereby vaporizing water in the receptacle. Each of the ferrite electrodes is a sintered body made of a mixture of iron oxide and a divalent nickel oxide. The ferrite electrodes are contained in an electrode assembly located within the body of the water receptacle such that a pair of electrode terminals extend through the top wall of the receptacle. A cover having a power source connector receiving concavity in its surface is positioned on top on the water receptacle. The cover is rotatable between a first position where the concavity is in registry with the electrode terminals and a second position where the concavity is out of registry with the terminals. A power source connector is received in the concavity and is connectable with the electrode terminals only when the cover is in the first position. When the connector is attached to the device, the cover is trapped between the body of the water receptacle and the connector, thereby preventing the removal of the cover. Thus the receptacle may not be filled and the electrodes may not be cleaned unless the power connector is removed from the electrode terminals. Additionally, when not in use, the cover may be rotated to the second position whereby the electrode terminals are protected from dust accumulation.

10 Claims, 7 Drawing Figures

ELECTRODE TYPE STEAM VAPORIZER HAVING CORROSION RESISTANT NICKEL FERRITE ELECTRODES AND A PROTECTIVE COVER

BACKGROUND OF THE INVENTION

1. Field of the Invention

The present invention relates to an electrode type steam vaporizer which feeds steam in a room to increase humidity and can be used for a long time in safety without need for cleaning the electrodes.

2. Description of the Prior Art

Electrode type steam vaporizers usually produce steam by dipping a pair of electrodes into water contained in a container and supplying AC current between the electrodes to heat the water.

The electrode type steam vaporizers humidify with steam whereby the temperature in a room is maintained and steam vaporization can be attained regardless of the room temperature.

In the conventional electrode type steam vaporizers, electrodes made of a metal such as stainless steel or electrodes made of graphite have been used. These electrodes are easily consumed or lack durability. Moreover, calcium oxide etc., is easily deposited on the surface of the electrodes, whereby the electrical conductivity of the surface of the electrodes is deteriorated, cleaning of the surface of the electrodes is required, and maintenance is difficult.

In detail, surfaces of electrodes (anode and cathode) made of graphite or stainless steel are corroded by a chemical reaction which deposits an impurity whereby it is necessary after about ten days to dissemble the electrodes and clean the surfaces of the electrodes. Accordingly, in the conventional electrode type steam vaporizers, an electrode unit or an electrode heater unit is assembled by holding the electrodes in a cylindrical housing having an opening. The unit is assembled in a container so as to be capable of assembly and disassembly therefrom by a simple hand operation such as a turning operation or a sliding operation relative to the container. Water is fed into the container after disassembly of the electrode unit from the container. However, since the electrode unit is easily disassembled to expose it by removing it from the container, a child may disassemble the electrode unit while playing and break the electrode plates. If the electrode unit is disassembled from the container without disconnecting it from the power source, an accident or electric shock may occur.

When the electrode unit is disassembled from the container for feeding water into the container, water on the electrode surface falls down to cause stains on the container. The conventional electrode type steam vaporizer is convenient for disassembling the electrode unit for cleaning of the electrode plates, however, there are various disadvantages as described above.

When the steam vaporizer is used only for few times or a corrosion of the surfaces of the electrodes is not substantially caused, it is seldom necessary to clean the electrodes whereby the simplicity of disassembly and assembly of the electrode unit is not an important function.

When the electrodes are not corroded, it is sufficient to clean them once every six months under normal use. In this case, it is not desirable from the viewpoint of safety to use a steam vaporizer having a common opening for both the connection of an electrode unit and a water inlet and which has a structure permitting easy disassembly of an electrode unit.

SUMMARY OF THE INVENTION

It is an object of the present invention to provide an electrode type humidifier whose maintenance is excellent because of the durability of electrodes which can be used for a long time without corrosion.

It is another object of the present invention to provide an electrode type steam vaporizer which can be disassembled without any accident or breakage of electrodes and wherein the container can be kept in sanitary condition by covering the upper part.

The foregoing and other objects can be attained by providing an electrode type steam vaporizer which includes a plurality of ferrite electrodes positioned in a water receptacle wherein AC voltage is applied to the electrodes thereby vaporizing water in the receptacle. Each of the ferrite electrodes is a sintered body made of a mixture of iron oxide and divalent metal oxide, such as Ni, Co, Fe, Mg, Zn, and Cu. The ferrite electrodes are contained in an electrode assembly located within the body of the water receptacle such that a pair of electrode terminals extend through the top wall of the receptacle. A cover having a power source connector receiving concavity in its surface is positioned on top of the water receptacle. The cover is rotatable between a first position where the concavity is in registry with the electrode terminals and a second position where the concavity is out of registry with the terminals. A power source connector is received in the concavity and is connectable with the electrode terminals only when the cover is in the first position. When the connector is attached to the device, the cover is trapped between the body of the water receptacle and the connector, thereby preventing the removal of the cover. Thus the receptacle may not be filled and the electrodes may not be cleaned unless the power connector is removed from the electrode terminals.

DETAILED DESCRIPTION OF THE PREFERRED EMBODIMENTS

Figure 1:
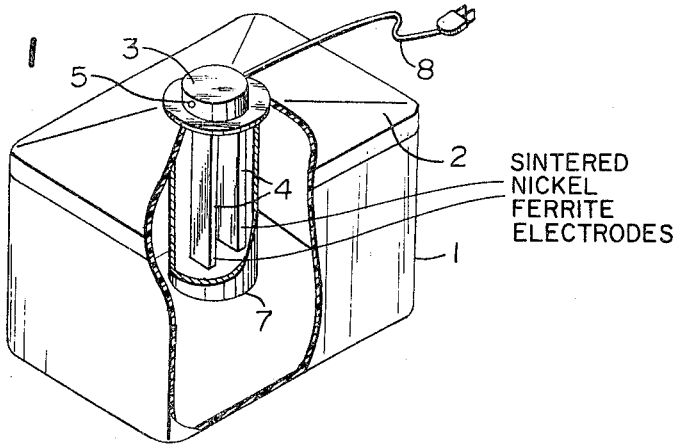
FIG. 1 is a partially broken schematic view of one embodiment of the electrode type steam vaporizer according to the present invention.

Referring to the drawings, the electrode type steam vaporizer of the present invention will be illustrated.

Figure 2:
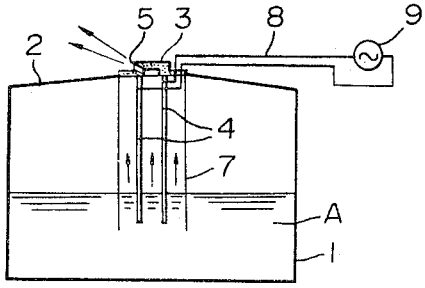
FIG. 2 is a schematic view illustrating the function of the electrode type steam vaporizer.

In FIGS. 1 and 2, a cover (2) is fitted at an upper opening of a vessel (1) containing water A, whereby a closed container is formed. A cap (3), which is detachable, is fitted at the central part of the cover (2). A pair of electrodes (4) made of ferrite oxide, hereinafter referred to as ferrite electrodes, are mounted at a rear surface of the cap (3). A steam outlet (5) is formed on the cap (3). An inner cylindrical housing (7) surrounding the ferrite electrodes (4) is held by the cap (3). A wire (8) is connected to the ferrite electrodes (4) whereby an AC power source (9) is connected to the ferrite electrodes.

In the structure, water A is filled in the vessel so that the level of water is higher than the lower edges of the ferrite electrodes (4) as shown in FIG. 2, and AC current is passed to the ferrite electrodes (4) whereby the water between the ferrite electrodes (4) is heated by Joule heat to convert it to steam and the steam is discharged through the steam outlet (5).

The ferrite electrode used in the present invention comprises a sintered body prepared by mixing a divalent metal oxide (MO) and an iron oxide at suitable ratio and shaping the mixture and sintering the shaped body. As the divalent metal, at least one of Ni, Co, Fe, Mg, Zn or Cu is selected. The data of electrode consumption of the ferrite electrodes and the other electrodes are shown in Table 1.

The ferrite electrode used in the tests is a sintered body prepared by sintering a shaped body of a mixture of iron oxide of 60 mole % as $Fe_2O_3$ and a nickel oxide of 40 mole %.

TABLE 1

| | Consumption of electrode | Operation time |
|---|---|---|
| Ferrite electrode | 0.625 mg | 5 days |
| Stainless steel electrode | 57.701 mg | 5 days |
| Carbon electrode | about 30 mg | 5 days |

Note:
Electrodes having the same size were used and water was added so as to maintain the level of water.

As it is clear from the data of Table 1, the consumption of the ferrite electrodes was remarkably smaller than that of the stainless steel electrodes. The consumption of the ferrite electrode was negligible and the ferrite electrode had excellent anticorrosive characteristics whereby the ferrite electrode can be used for a long time, that is, it has a long life.

A metal oxide, inhibiting electric conductivity, does not adhere to the surface of the ferrite electrode, as contrasted with the stainless steel electrode, whereby the electric conductivity can be maintained such that sufficient current to vaporize steam will flow, that is, sufficient steam can be obtained.

The data of steam vaporized by using the ferrite electrodes and other electrodes are shown in Table 2. In the tests, 3 liters of water was utilized in the container and the steam vaporization was continued without adding water.

TABLE 2

| Time for passing current (hour) | Ferrite electrode | Stainless steel electrode | Graphite electrode |
|---|---|---|---|
| 4 | 0.84 lit. | 0.49 lit. | 0.25 lit. |
| 8 | 2.45 lit. | 0.98 lit. | 0.45 lit. |
| 20 | 2.84 lit. | 2.51 lit. | 1.10 lit. |
| 24 | 2.93 lit. | 2.73 lit. | 1.20 lit. |
| Note | Note 1 | Note 2 | Note 3 |

Note 1: After 8 hours, water was reduced whereby steam was reduced.
Note 2: After 20 hours, water was reduced whereby steam was reduced.
Note 3: Steam was small.

It is clear that when the ferrite electrodes were used, a large amount of steam can be generated as shown in Table 2.

A metal oxide, inhibiting electric conductivity was, does not adhere when using the ferrite electrodes, whereby the necessity for cleaning the electrodes can be reduced and the operation can be simplified.

In the embodiment, a pair of ferrite electrodes are used. But, it is possible to use three or more electrodes.

In accordance with the present invention, the electrode type humidifier having high durability and excellent maintainability can be obtained by using the ferrite electrodes as electrodes passing for current through water.

Referring to FIGS. 3 to 7, the other embodiment of electrode type steam vaporizer will be described.

In the embodiment, a water inlet and a steam outlet are separately disposed at the upper part of the container body containing water.

Electrodes projected into the container are fixed with screws at the upper part of the container. The upper part of the container is covered with a cover except for the steam outlet. The container body is fixed through a detectable power source connector to the cover as will be described below in detail. For example, the power source connector is detachably connected to the electrode unit to a portion of the container body. The connector passes over a portion of the cover, whereby the cover can not be removed from the container body without disconnecting the power source connector.

The electrode type steam vaporizer uses ferrite electrodes having anticorrosive characteristics as described above. However, when the times for cleaning the electrodes appear infrequent, the other electrodes can be used.

Figure 3:
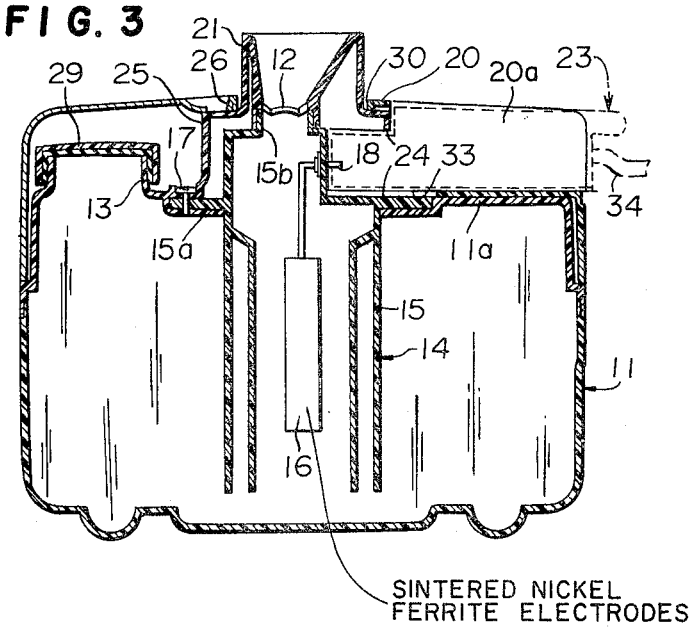
FIG. 3 is a sectional view of the other embodiment of the electrode type steam vaporizer according to the present invention.
Figure 4:
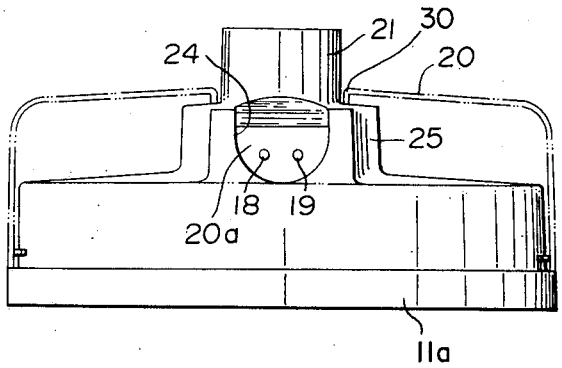
FIG. 4 is a side view of the upper part of the body of the container of FIG. 3.

FIG. 3 is a sectional view of one embodiment of the electrode type steam vaporizer of the present invention. The container body (11) has the steam outlet (12) at the central upper part of the container body and the water inlet (13) at a separate position. A flange (21) is formed around the steam outlet (12) and a central part (25) is formed around the flange (21). The central part (25) has a semi-circular periphery as shown in FIG. 4, and includes a side hole (24) formed therethrough. A cap (20) covers the water inlet (13). The electrode unit (14) comprises a pair of ferrite electrodes (16) contained in a cylindrical housing (15) which is open at both ends. The cylindrical housing (15) of the electrode unit (14) has a flange (15*a*) at the peripheral part. At a portion of the peripheral part of the cylindrical housing above the flange (15*a*), a flat surface is formed and terminals (18), (19) are disposed on the flat surface. The electrodes (16) are connected to the terminals in the cylindrical housing. The upper opening (15*b*) of the cylindrical housing (15) of the electrode unit (14) is matched with the steam outlet (12) of the container body (11) and the flange (15*a*) of the cylindrical housing is fixed to the upper part of the container body (11) with screws (17). The positions of the terminals (18), (19) of the cylindrical housing are disposed at a position facing the side opening (24) of the container body (11). A cover (20) encloses the upper part of the container body (11) exposing the flange (21) of the steam outlet (12). A part of the upper surface of the cover (20) adjacent to the side opening (24) is concave whereby an upper surface concavity (20*a*) radially extending from the central hole (30) to the peripheral part of the cover (20) is formed.

Figure 6:
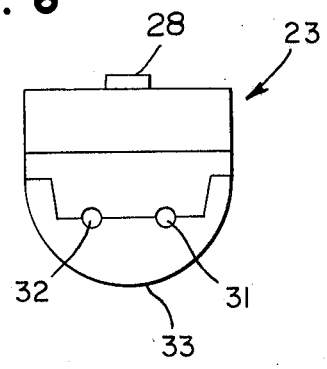
FIG. 6 is a side view of one side surface of the power source connector shown in FIGS. 3 and 5.

As shown in FIG. 6, sockets (31), (32) connected to the terminals (18), (19) are disposed at one end of the power source connector (23) as shown in FIG. 6. A semi-circular shape, the same as the side opening (24) of the container body (11), is formed at the lower surface (33) of the power source connector (23).

In order to connect the power source connector (23) to the terminals (18), (19) of the electrode unit (14), the cover (20) is rotated to align the upper concavity (20*a*) with the side opening (24) of the container body (11) thereby exposing the terminals (18), (19).

Figure 5:
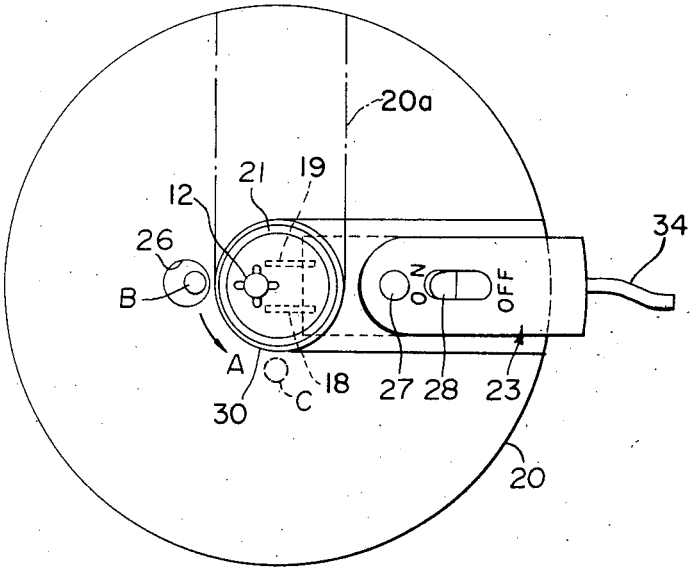
FIG. 5 is a plan view of the electrode type steam vaporizer of FIG. 3.

The lower surface (33) of the power source connector (23) is slipped on the upper surface of concavity (20*a*) of the cover (20) to insert it into the side opening (24) of the container body (11) and the sockets (31), (32) at the edge of the power source connector are connected to the terminals (18), (19) whereby the electrodes (16) are connected through the wires (34) to the power source (not shown). A switch (28) is disposed at the upper surface of the power source connector (23) and a display lamp (27) for indicating current passage is provided as shown in FIG. 5.

In this condition, the concavity (20*a*) of the cover (20) is disposed between the lower surface (33) of the power source connector (23) and the upper surface (11*a*) of the container body (11) whereby the cover (20) can not be taken off without disconnecting the power source connector (23). When water is fed into the container body (11) or the electrodes (16) are cleaned after a long use, the power source connector (23) is first disconnected from the container body (11) and the cover (20) is then taken off and water is fed through the water inlet (13). The screws (17) may also be unfastened and the electrode unit (14) may be removed.

When the power source connector (23) is disconnected the cover (20) can be turned for a certain angle relative to the container body (11). An aperture (26) is formed at the upper surface of the cover (20) overlying the upper surface of the central part (25) of the container body (11). At the upper surface of the central part (25), the symbols C and B are shown as in FIG. 5 (the symbols mean Open and Close in FIG. 5).

When the cover (20) is put on the container body and is arranged so as to be capable of connecting the power source connector (23), the cover (20) is turned to move the aperture (26) to the closed position B at the central part (25). It is preferable to provide a suitable connection between the container body (11) and the cover (20) such that the cover (20) may be disconnected when the cover (20) is turned in the direction of the arrow A in FIGS. 5 and 7 to move the aperture (26) to the open position C.

As described above, in accordance with the electrode type steam vaporizer of the present invention, even though the ferrite electrodes have high chemical resistance and anticorrosive characteristics they are easily broken. Breakage of the electrodes is reduced and safety is attained by providing the structure of the present invention which enables water to be fed without disassembling the electrode unit. The electrode unit is fixed to the container body and the cover can not be removed and the electrode unit can not be exposed without disconnecting the power source connection.

In the conventional electrode type steam vaporizer, the concavo-convex part is formed at the upper surface whereby it is not easy to clean the concavo-convex part when dust is deposited. However, in the present invention, the cover is formed in the simple outer shape as shown in FIG. 7 whereby dust deposited on the cover can be easily removed.

Figure 7:
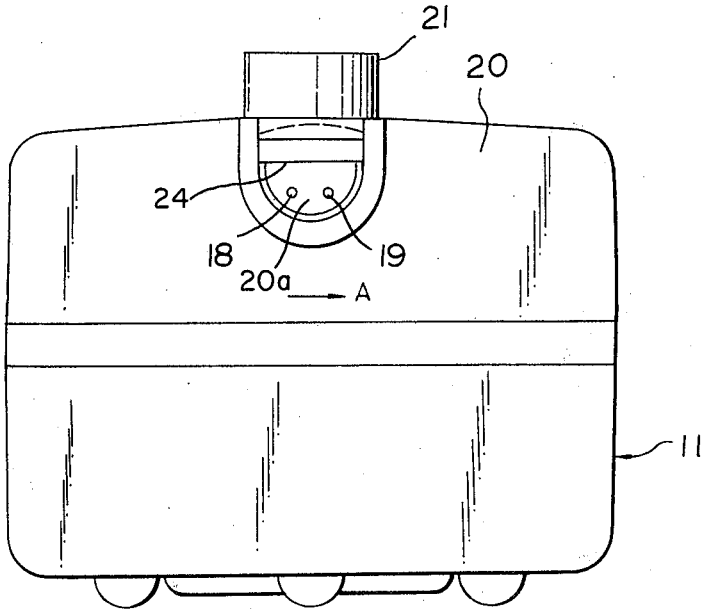
FIG. 7 is a side view of the electrode type steam vaporizer of FIG. 3.

When the steam vaporizer is not used for a long time, the cover (20) is turned in the direction of the arrow A shown in FIG. 7 so as to completely cover the side opening (24) and terminals (18) and (19) of the electrode unit whereby the terminals can be protected from dust.

The present invention has been illustrated with certain embodiments. Thus, the assembly of the cover and the container body with the power source connector can be modified within the scope of the claimed invention.

What is claimed is:

1. An electrode type steam vaporizer, comprising:
   a container for water having an upper surface with a steam outlet; and
   a plurality of spaced apart ferrite electrodes extending into the container and having electrode terminals extending through said upper surface of said container for connection to an AC voltage source to heat water therein and produce steam when AC voltage is applied to the electrodes, said electrodes each including a sintered body prepared by sintering a shaped body of a mixture of 60 mole percent $Fe_2O_3$ with 40 mole percent divalent nickel oxide.

2. An electrode type steam vaporizer according to claim 1 wherein the electrodes made of ferrite are fixed in a cylindrical housing to form an electrode unit and the electrode unit is fixed in said container.

3. An electrode type steam vaporizer according to claim 2, which further comprises:
   a removable cover having a power source connector receiving concavity supported on said container in a covering relation to the upper surface thereof, said cover being rotatable relative to said container between a first position wherein said concavity is in registry with said electrode terminals and a second position wherein said concavity is out of registry with said electrode terminals; and
   a power source connector adapted to be releasably connected with the electrode terminals only when said cover is in said first position, said connector being received in said concavity whereby said cover is trapped between the connector and the upper surface of said container when said connector is connected to said electrode terminals, said cover thus being incapable of being moved or removed so long as the power source connector is connected with the electrode terminals, said cover serving both as a dust cover and as a safety device which prevents access to the electrodes and the interior of the container when the power source connector is connected with the electrodes.

4. An electrode type steam vaporizer according to claim 1 wherein the steam outlet and a water inlet for adding water are separately formed at the upper surface of the container.

5. An electrode type steam vaporizer according to claim 1, wherein:
   a cover is disposed on said container, covering the upper surface of the container and the plurality of ferrite electrodes.

6. An electrode type steam vaporizer, comprising:
   a container body having a bottom wall, a top wall and side walls;
   said top wall having a first opening therethrough for receiving an electrode assembly and a second opening for introducing water into the container;
   an electrode assembly received through the first opening and including a plurality of spaced apart ferrite electrodes extending into the container for heating water therein, said electrodes having connecting terminals extended through the top wall;

a removable cover having a power source connector receiving concavity supported on the container body in covering relation to the first and second openings, said cover being rotatable relative to the container between a first, closed position wherein said concavity is in registry with said electrode terminals and a second, open position, wherein said concavity is out of registry with said electrode terminals; and a power source connector adapted to be releasably connected with the electrodes via the terminals only when said cover is in its closed position, said connector being received in said concavity whereby the cover is trapped between the connector and the top wall of the container when the connector is connected to the electrode terminals, said cover thus being incapable of being moved so long as the power source connector is connected with the terminals, and said cover being movable to its open position to cover the electrode terminals, or being removable from the container to permit addition of water to the container and removal of the electrodes only when the power source connector is removed, the cover serving both as a dust cover and as a safety device which prevents access to the electrodes or interior of the container when the power source connector is connected with the electrodes.

7. An electrode type steam vaporizer according to claim 6 wherein the electrodes each comprise a sintered body prepared by sintering a shaped body of a mixture of iron oxide of 60 mole % as $Fe_2O_3$ and divalent nickel oxide of 40 mole %.

8. An electrode type steam vaporizer according to claim 6 wherein the ferrite is a mixture of a divalent metal oxide and an iron oxide and the divalent metal is selected from the group consisting of Ni, Co, Fe, Mg, Zn and Cu.

9. An electrode type steam vaporizer according to claim 6 wherein said ferrite electrodes each comprise a sintered body prepared by sintering a shaped body of a mixture of 60 mole percent $Fe_2O_3$ with 40 mole percent divalent nickel oxide.

10. An electrode type steam vaporizer, comprising:

a container for water having an upper surface with a steam outlet;

a plurality of spaced apart ferrite electrodes extending into the container and having electrode terminals extending through said upper surface of said container for connection to an AC voltage source to heat water therein and produce steam when AC voltage is applied to the electrodes, said electrodes each including a sintered body prepared by sintering a shaped body of a mixture of 60 mole percent $Fe_2O_3$ with 40 mole percent divalent nickel oxide, said ferrite electrodes being fixed in a cylindrical housing to form an electrode unit, said electrode unit being fixed in said container;

a removable cover having a power source connector receiving concavity supported on said container in a covering relation to the upper surface thereof, said cover being rotatable relative to said container between a first position wherein said concavity is in registry with said electrode terminals and a second position wherein said concavity is out of registry with said electrode terminals; and a power source connector adapted to be releasably connected with the electrode terminals only when said cover is in said first position, said connector being received in said concavity whereby said cover is trapped between the connector and the upper surface of said container when said connector is connected to said electrode terminals, said cover thus being incapable of being moved or removed so long as the power source connector is connected with the electrode terminals, said cover serving both as a dust cover and as a safety device which prevents access to the electrodes and the interior of the container when the power source connector is connected with the electrodes.

* * * * *